US009689336B2

(12) United States Patent
Hardy et al.

(10) Patent No.: US 9,689,336 B2
(45) Date of Patent: Jun. 27, 2017

(54) ENGINE SYSTEM UTILIZING MODAL WEIGHTED ENGINE OPTIMIZATION

(71) Applicant: Caterpillar Inc., Peoria, IL (US)

(72) Inventors: William L. Hardy, Dunlap, IL (US); Christopher K. Wackerle, Peoria, IL (US); Jeffrey J. Ribordy, Chillicothe, IL (US); Timothy E. Applegren, Washington, IL (US); Michael S. Bond, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 298 days.

(21) Appl. No.: 14/537,134

(22) Filed: Nov. 10, 2014

(65) Prior Publication Data

US 2016/0131068 A1 May 12, 2016

(51) Int. Cl.

| | |
|---|---|
| ***F02D 41/00*** | (2006.01) |
| ***F02D 41/24*** | (2006.01) |
| *F02D 41/14* | (2006.01) |

(52) U.S. Cl.

CPC ..... *F02D 41/2422* (2013.01); *F02D 41/2429* (2013.01); *F02D 41/2438* (2013.01); (Continued)

(58) Field of Classification Search

CPC ..... F02D 41/1402; F02D 41/1404; F02D 41/2429; F02D 41/2432; F02D 41/2438; (Continued)

(56) References Cited

U.S. PATENT DOCUMENTS 4,403,584 A 9/1983 Suzuki et al.
5,303,163 A * 4/1994 Ebaugh ..... G07C 5/085 340/439

(Continued)

FOREIGN PATENT DOCUMENTS

EP 0919419 A1 6/1999
WO WO 2009/088437 A1 7/2009

OTHER PUBLICATIONS

U.S. Patent Application of Jeffrey J. Ribordy et al., entitled "Engine System Utilizing Selective Engine Optimization" filed on Nov. 10, 2014.

(Continued)

*Primary Examiner* — Erick Solis
(74) *Attorney, Agent, or Firm* — Finnegan, Henderson, Farabow, Garrett & Dunner, LLP

(57) ABSTRACT

An engine system is disclosed. The engine system may have an engine. The engine system may also have a sensor configured to generate a sensor signal indicative of an amount of power generated by the engine and a speed sensor configured to generate a speed signal indicative of a speed of the engine. The engine system may also have a controller configured to receive the sensor signal and the speed signal. The controller may also be configured to generate an operating histogram based on the sensor signal and the speed signal. Further the controller may be configured to receive modal points for the engine, the modal points having associated emissions limits. The controller may also be configured to generate a calibration parameter set for the operating histogram based on the weights. In addition, the controller may be configured to apply the calibration parameter set to the engine.

20 Claims, 7 Drawing Sheets

(52) U.S. Cl.
CPC ..... *F02D 41/2477* (2013.01); *F02D 41/1406* (2013.01); *F02D 2041/1425* (2013.01); *F02D 2200/101* (2013.01); *F02D 2200/1002* (2013.01)

(58) Field of Classification Search
CPC ..... F02D 41/2477; F02D 2041/1425; F02D 2200/0614; F02D 2200/0616; F02D 2200/1002; F02D 2200/1004; F02D 2200/101
See application file for complete search history.

(56) References Cited

U.S. PATENT DOCUMENTS 5,463,567 A * 10/1995 Boen ..... G07C 3/00 701/33.4
5,523,948 A 6/1996 Adrain
5,619,412 A 4/1997 Hapka
5,749,346 A 5/1998 Halvorson et al.
5,948,026 A * 9/1999 Beemer, II ..... G07C 5/085 701/115
5,954,617 A * 9/1999 Horgan ..... B60K 31/047 123/349
6,076,037 A 6/2000 Ono et al.
6,269,300 B1 7/2001 Moore-McKee et al.
6,321,142 B1 11/2001 Shutty
6,438,511 B1 * 8/2002 McKenzie ..... F02D 41/2425 701/101
6,535,811 B1 3/2003 Rowland et al.
6,560,528 B1 5/2003 Gitlin et al.
6,671,603 B2 12/2003 Cari et al.
6,965,826 B2 11/2005 Andres et al.
7,206,689 B1 4/2007 Johnson
7,409,285 B2 8/2008 Kang et al.
7,415,389 B2 8/2008 Stewart et al.
7,676,318 B2 3/2010 Allain
8,041,511 B2 10/2011 Riegel et al.
8,346,430 B2 1/2013 Przymusinski et al.
8,412,406 B2 4/2013 Johnson et al.
8,560,143 B2 10/2013 Fleming et al.
8,612,107 B2 12/2013 Malikopoulos
8,914,184 B2 12/2014 McQuade et al.
9,227,479 B2 1/2016 Clarke et al.
9,229,906 B2 1/2016 McQuade et al.
9,346,469 B2 5/2016 Glugia et al.
2002/0059075 A1 5/2002 Schick et al.
2004/0249558 A1 12/2004 Meaney
2007/0027592 A1 2/2007 Tolkacz
2009/0240391 A1 9/2009 Duddle et al.
2010/0100292 A1 4/2010 Lv
2010/0204882 A1 8/2010 Giovaresco et al.
2011/0054768 A1 3/2011 Sullivan
2012/0253637 A1 10/2012 Jiang et al.
2013/0238222 A1 9/2013 Okamoto
2013/0261846 A1 10/2013 McQuade et al.
2013/0261874 A1 10/2013 McQuade et al.
2014/0040434 A1 2/2014 Rybak et al.
2014/0109868 A1 4/2014 Zhu et al.
2014/0148928 A1 5/2014 Stewart
2016/0102626 A1 * 4/2016 Johansson ..... G01M 15/05 701/114
2016/0131062 A1 5/2016 Ribordy et al.
2016/0131069 A1 * 5/2016 Wackerle ..... F02D 41/2429 701/115

OTHER PUBLICATIONS

U.S. Patent Application of Christopher K. Wackerle et al., entitled "Engine System Utilizing Cloud Based Engine Optimization" filed on Nov. 10, 2014.

* cited by examiner

ENGINE SYSTEM UTILIZING MODAL WEIGHTED ENGINE OPTIMIZATION

TECHNICAL FIELD

The present disclosure relates generally to an engine system and, more particularly, to an engine system utilizing modal weighted engine optimization.

BACKGROUND

Internal combustion engines may be used in a variety of applications to provide motive power, for example, to move machinery or to generate electrical power. Even within a single application, however, engines may operate under widely varying conditions. For example, a mining truck at one work site may climb uphill in an unloaded state but travel downhill carrying a full load of material. At another site, a similar mining truck may go downhill in an unloaded state but return uphill in a fully loaded state. Thus, similar engines in the two mining trucks may have vastly different performance requirements while travelling uphill or downhill. As a result, similar engines may require different engine settings to optimize engine performance during use.

Internal combustion engines generate exhaust as a by-product of fuel combustion within the engines. Engine exhaust contains, among other things, unburnt fuel, particulate matter such as soot, and gases such as carbon monoxide or nitrous oxide. Regulatory agencies have imposed limits on the maximum amounts of exhaust emissions that an engine may release into the atmosphere during operation. Modern engines must, therefore, deliver optimum performance without exceeding the emissions limits imposed by the emissions control regulations. Typically, an engine manufacturer provides an engine to an end user with a default calibration parameter set, which specifies default values for various control parameters for the engine. The engine manufacturer determines the default values based on an expected use of the engine. Although the default calibration parameter set may ensure compliance with emissions control regulations, an engine operating with the default calibration parameter set may not be fully optimized for the actual usage cycle.

One attempt to address some of the problems described above is disclosed in U.S. Pat. No. 6,965,826 of Andres et al. issued on Nov. 15, 2005 ("the '826 patent"). In particular, the '826 patent discloses an electronically controlled internal combustion engine in which a plurality of different engine control calibration algorithms are made available to an engine control system. The '826 patent explains that each control calibration algorithm corresponds to a particular duty cycle while being optimized for a performance parameter such as reduced emissions under a variety of constraints. The '826 patent discloses that an operator can choose from among several different available duty cycles for the machine and that the control system selects a control calibration algorithm corresponding to the selected duty cycle. The '826 patent also discloses an embodiment where a duty cycle determiner predicts a future duty cycle based on historical engine operation data. The control system of the '826 patent selects a control calibration algorithm based on the predicted duty cycle. Further, the '826 patent discloses an embodiment in which the control system determines a control calibration algorithm for a predicted duty cycle by optimizing a particular performance parameter under known constraints, such as, emissions regulations and customer specific requirements.

Although the '826 patent discloses selection of a control calibration algorithm based on duty cycle, the disclosed system may still be less than optimal. In particular, the system of the '826 patent selects from control calibration algorithms optimized for a single performance parameter such as reduced emissions. These algorithms, however, may still not provide optimal engine operation, for example, by simultaneously reducing emissions and fuel consumption. Further, the duty cycle predictor of the '826 patent selects a duty cycle that provides the best match between the historical engine operation data and predetermined duty cycles. The system of the '826 patent then selects or determines a control calibration algorithm for the predicted duty cycle. Selecting the control calibration algorithm based on historical operation data and limiting selection of the control calibration algorithm to one of the predetermined duty cycles may be sub-optimal because actual engine operation may differ significantly from the predicted duty cycle. For example, as discussed earlier, even when a machine performs the same operation (e.g. mining), an engine associated with the machine may still have widely varying performance requirements based on the terrain over which the machine operates. Thus, relying on historical engine performance data may not yield optimal engine performance. In addition, determining a control calibration algorithm by optimizing a particular performance parameter may not be feasible if the control system has limited processing capabilities.

The engine system of the present disclosure solves one or more of the problems set forth above and/or other problems of the prior art.

SUMMARY

In one aspect, the present disclosure is directed to an engine system. The engine system may include an engine. The engine system may also include a sensor configured to generate a sensor signal indicative of an amount of power generated by the engine. Further, the engine system may include a speed sensor configured to generate a speed signal indicative of a speed of the engine. The engine system may also include a controller. The controller may be configured to receive the sensor signal and the speed signal. The controller may also be configured to generate an operating histogram based on the sensor signal and the speed signal. Further the controller may be configured to receive modal points for the engine, the modal points having associated emissions limits. Each modal point may include a speed of the engine and an amount of output power of the engine corresponding to the speed. The controller may also be configured to generate a calibration parameter set for the operating histogram based on the weights. In addition, the controller may be configured to apply the calibration parameter set to the engine.

In another aspect, the present disclosure is directed to a method of optimizing an operation of an engine. The method may include receiving, from a sensor, a sensor signal indicative of an amount of power generated by the engine. The method may also include receiving, from a speed sensor, a speed signal indicative of a speed of the engine. The method may further include generating, using a controller, an operating histogram based on the sensor signal and the speed signal. The method may also include selecting an engine rating from among a plurality of engine ratings based on the operating histogram. The method may also include defining modal points for the engine, the modal points having associated emissions limits. Each modal point may include a speed of the engine and an amount of output power of the engine corresponding to the speed. The method may also include assigning weights to the modal points based on the operating histogram. Further the method may include generating a calibration parameter set for the operating histogram based on the weights. In addition, the method may include applying the calibration parameter set to the engine.

In yet another aspect, the present disclosure is directed to an engine. The engine may include a crankshaft. The engine may also include a combustion chamber. The engine may further include a fuel injector configured to inject fuel into the combustion chamber. In addition, the engine may include a piston disposed reciprocatingly within the combustion chamber. The piston may be configured to rotate the crankshaft. The engine may also include a sensor configured to generate a sensor signal indicative of power output by the engine. Further the engine may include a speed sensor configured to generate a speed signal indicative of a speed of the engine. In addition, the engine may include a controller. The controller may be configured to receive the sensor signal and the speed signal. The controller may also be configured to generate an operating histogram based on the sensor signal and the speed signal. Further, the controller may be configured to receive modal points for the engine. The modal points may have associated emissions limits. Each modal point may include a speed of the engine and an amount of output power of the engine corresponding to the speed. The controller may be configured to assign weights to the modal points based on the operating histogram. Further, the controller may be configured to select engine ratings for the operating histogram based on the weights. The controller may also be configured to apply the engine ratings to the engine.

DETAILED DESCRIPTION

Figure 1:
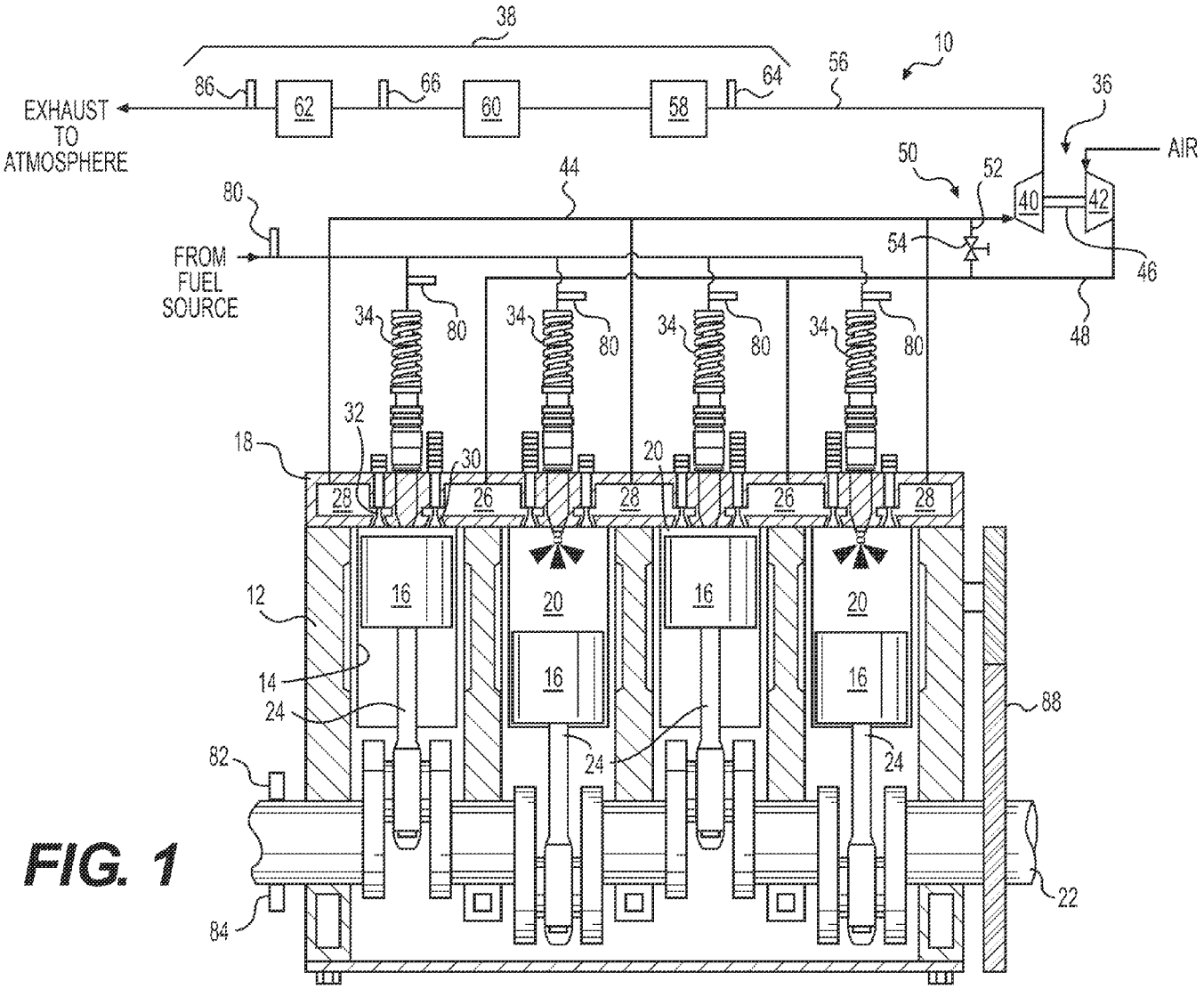
FIG. 1 is a pictorial illustration of an exemplary disclosed engine.

FIG. 1 illustrates an exemplary engine 10. Engine 10 may be any type of engine such as, for example, a diesel engine, a gasoline engine, or a gaseous-fuel powered engine. Engine 10 may include an engine block 12 that defines a plurality of cylinders 14. A piston 16 and a cylinder head 18 may be associated with each cylinder 14 to form a combustion chamber 20. Specifically, piston 16 may be slidably disposed within each cylinder 14 to reciprocate between a top-dead-center position and a bottom-dead-center position. Cylinder head 18 may be positioned to cap off an end of cylinder 14, thereby forming a combustion chamber 20. In the embodiment illustrated in FIG. 1, engine 10 includes four combustion chambers 20. It is contemplated, however, that engine 10 may include any number of combustion chambers 20. Further, as illustrated in FIG. 1, combustion chambers 20 of engine 10 may be disposed in an in-line arrangement. It is contemplated, however, that combustion chambers 20 may be disposed in a V-shaped arrangement, or in any other suitable arrangement.

Engine 10 may include a crankshaft 22 rotatably disposed within engine block 12. A connecting rod 24 may connect each piston 16 to crankshaft 22 so that a sliding motion of piston 16 between the top-dead-center and bottom-dead-center positions within each respective cylinder 14 may result in a rotation of crankshaft 22. Similarly, a rotation of crankshaft 22 may result in a sliding motion of piston 16 between the top-dead-center and bottom-dead-center positions. In a four-stroke engine, piston 16 may reciprocate between the top-dead-center and bottom-dead-center positions through an intake stroke, a compression stroke, a combustion or power stroke, and an exhaust stroke.

Cylinder head 18 may define an intake passageway 26 and an exhaust passageway 28 associated with each combustion chamber 20. Intake passageway 26 may direct air into combustion chamber 20 via intake valve 30. Exhaust passageway 28 may direct exhaust gases from combustion chamber 20 via exhaust valve 32 to the atmosphere. Engine 10 may also include a fuel injector 34 associated with each combustion chamber 20. In particular, each fuel injector 34 may be disposed within a cylinder head 18 and may be operable to inject an amount of pressurized fuel into the associated combustion chamber 20 at predetermined fuel injection timings, fuel injection pressures, and amounts of fuel injection. Fuel injector 34 may embody any type of electronically controlled fuel injection device such as, for example, an electronically actuated—electronically controlled injector, a mechanically actuated—electronically controlled injector, a digitally controlled fuel valve associated with a high pressure common rail, or any other type of fuel injector known in the art.

Engine 10 may include a turbocharger 36 and an after-treatment system 38. As illustrated in FIG. 1, turbocharger 36 may include a turbine stage 40 and a compressor stage 42. Turbine stage 40 may be a fixed geometry turbine or a variable geometry turbine. Exhaust gases from exhaust passageways 28 may be directed to turbine stage 40 of turbocharger 36 via passageway 44. As the hot exhaust gases move through turbine stage 40 and expand against blades (not shown) of turbine wheel (not shown), the turbine wheel may rotate shaft 46 which in turn may rotate compressor impeller (not shown) within compressor stage 42. Compressor stage 42 may embody a fixed geometry compressor impeller (not shown) attached to shaft 46 and may be configured to compress air received from an ambient to a predetermined pressure level. Air from compressor stage 42 may be delivered to intake passageways 26 of engine 10 via passageway 48. Although FIG. 1 illustrates only one turbocharger 36, it is contemplated that engine 10 may include any number of turbochargers 36. It is also contemplated that engine 10 may include other components such as air coolers, air filters, check valves, control valves, etc.

Engine 10 may also include exhaust gas recirculation (EGR) arrangement 50. EGR arrangement 50 may include passageway 52 and control valve 54. Control valve 54 may regulate a flow of exhaust in passageway 52. For example, control valve 54 may selectively direct a portion of exhaust from passageway 44 to flow via passageway 52 to passageway 48. The mixture of air and the portion of exhaust may enter intake passageways 26, which may direct the mixture into combustion chambers 20.

After-treatment system 38 may receive exhaust from turbine stage 40 of turbocharger 36 via passageway 56. After-treatment system 38 may treat the exhaust before discharging the exhaust into an ambient. After-treatment system 38 may include one or more diesel oxidation catalysts (DOC) 58, one or more diesel particulate filters (DPF) 60, one or more selective catalytic reduction (SCR) units 62, one or more hydrocarbon dosers 64, and/or one or more reductant injectors 66. DOC 58 may be located upstream from DPF 60 so that exhaust in passageway 56 may pass through DOC 58 before passing through DPF 60. DPF 60 may trap particulate matter, for example, soot in the exhaust flowing in passageway 56. When DOC 58 reaches an activation (or light-off) temperature, nitrous oxide flowing through passageway 56 may interact with the soot trapped in DPF 60 to oxidize some or all of the soot trapped in DPF 60. One or more hydrocarbon dosers 64 may be disposed upstream from DOCs 58. Hydrocarbon doser 64 may inject fuel into the exhaust flowing in passageway 56. The injected fuel may mix with the exhaust before the exhaust reaches DOC 58 and DPF 60. The fuel injected by hydrocarbon dosers 64 may be the same fuel that is used by engine 10 or may be any other type of fuel that can be oxidized to produce heat, which may be used to heat up DOC 58 to its activation temperature, raise a temperature of the exhaust, and/or to oxidize the particulate matter trapped in DPF 60. It is contemplated that, additionally or alternatively, other components such as one or more burners, valves, bypass coolers, and/or other mechanisms, for example, throttling the intake of engine 10 may be used to control the temperature of the exhaust for regenerating DPF 60 or for controlling the temperature of DOC 58 catalysts in SCR unit 62 to improve the efficiency of DOC 58 and/or catalysts in SCR unit 62.

DOC 58, may include a flow-through substrate having, for example, a honeycomb structure or any other equivalent structure with many parallel channels for exhaust to flow through. The honeycomb or other structure of the substrate in DOC 58 may increase the contact area of the substrate to exhaust, allowing more of the undesirable constituents to be oxidized as exhaust in passageway 56 passes through DOC 58. A catalytic coating (for example, of a platinum group metal) may be applied to the surface of the substrate to promote oxidation of some constituents (such as, for example, hydrocarbons, carbon monoxide, oxides of nitrogen, etc.) of exhaust as it flows through DOC 58.

DPF 60 may be a device used to physically separate particulate matter such as soot from the exhaust in passageway 56. DPF 60 may include a wall-flow substrate. In one exemplary embodiment, DPF 60 may include a flow-through arrangement. Exhaust may pass through walls of DPF 60, leaving larger particulate matter accumulated on the walls. It is contemplated that DPF 60 may be a filter, wire mesh screen, or may have any other suitable configuration known in the art for trapping soot particles. As is known in the art, DPF 60 may be regenerated periodically to clear the accumulated particulate matter. Additionally or alternatively, DPF 60 may be removed from engine 10 and cleaned or replaced during routine maintenance.

SCR unit 62 may be a device having one or more serially-arranged catalyst substrates (not shown) located downstream from one or more reductant injectors 66. A gaseous or liquid reductant, most commonly urea ($(NH_2)_2CO$), a water/urea mixture, a hydrocarbon such as diesel fuel, or ammonia gas ($NH_3$), may be sprayed or otherwise advanced into the exhaust within passageway 56 at a location upstream of the catalyst substrates by one or more reductant injectors 66. The reductant sprayed into passageway 56 may flow downstream with the exhaust from engine 10 and be adsorbed onto the surface of the catalyst substrate, where the reductant may react with $NO_X$ (NO and $NO_2$) in the exhaust gas to form water ($H_2O$) and elemental nitrogen ($N_2$). This process performed by SCR unit 62 may be most effective when a concentration of NO to $NO_2$ supplied to SCR unit 62 is about 1:1. Although FIG. 1 illustrates one each of DOC 58, DPF 60, SCR unit 62, hydrocarbon doser 64, and reductant injector 66, it is contemplated that engine 10 may include any number of DOCs 58, DPFs 60, SCR units 62, hydrocarbon dosers 64, and reductant injectors 66.

Engine 10 may also include one or more fuel sensors 80, torque sensors 82, speed sensors 84, and emissions sensors 86. Fuel sensor 80 may be configured to measure an amount of fuel being injected by fuel injector 34 into combustion chamber 20. Fuel sensor 80 may be a flow-rate sensor, or any other type of fuel flow sensor known in the art. In one exemplary embodiment, fuel sensor 80 may measure a current flowing through fuel injector 34 and the amount of fuel may be determined based on a table, equation, or a map relating the current to the amount of fuel. A separate fuel sensor 80 may be provided to measure the amount of fuel being injected by each fuel injector 34 into a combustion chamber 20 associated with that fuel injector 34. Additionally or alternatively, a fuel sensor 80 may be provided to measure a total amount of fuel being injected by all fuel injectors 34 into combustion chambers 20. Torque sensor 82 may be configured to determine an amount of torque that may be generated by engine 10. Torque sensor 82 may embody a strain gage type sensor, a phase angle shift measurement type sensor, or any other type of torque measurement sensor known in the art.

Speed sensor 84 may be configured to determine a speed of the engine. Speed sensor 84 may embody a magnetic pickup-type sensor. In one exemplary embodiment, speed sensor 84 may be associated with a flywheel 88 of engine 10 and configured to sense a rotational speed of flywheel 88 and produce a corresponding speed signal. In another exemplary embodiment, speed sensor 84 may be associated with crankshaft 22 and may be configured to sense a rotational speed of crankshaft 22 and produce a corresponding speed signal. A sensor signal generated by fuel sensor 80 and/or torque sensor 82 may be indicative of an amount of power generated by engine 10. In one exemplary embodiment, a sensor signal from fuel sensor 80 representative of an amount of fuel consumed by engine 10 at a given speed may be indicative of the amount of power being generated by engine 10. In another exemplary embodiment, torque measured using torque sensor 82 and a speed measured by speed sensor 84 may be used to determine an amount of power being generated by engine 10. It is contemplated, however, that the amount of power generated by engine 10 may be determined by, for example, using equations, maps, and/or tables that relate a speed of engine 10, a torque being generated by engine 10, and/or an amount of fuel consumption of engine 10 to the amount of power generated by engine 10. It is also contemplated that the amount of power generated by engine 10 may be determined based on measurement of other engine parameters known in the art.

Emissions sensor 86 may be configured to determine an amount of emissions being released to the atmosphere in the exhaust leaving after-treatment system 38. In one exemplary embodiment, emissions sensor 86 may be a physical $NO_x$ emission sensor, which may measure the $NO_x$ emission level. In another exemplary embodiment, emissions sensor 86 may provide calculated values of $NO_x$ emission level based on other measured or calculated parameters, such as compression ratios, turbocharger efficiency, after-cooler characteristics, temperature values, pressure values, ambient conditions, fuel rates, and engine speeds, etc. It is contemplated that emissions sensor 86 may embody other types of sensors known in the art to determine an amount of soot or amounts of other emissions components in the exhaust from engine 10.

Although FIG. 1 illustrates only one each of fuel sensor 80, torque sensor 82, speed sensor 84, and emissions sensor 86, it is contemplated that engine 10 may have any number of fuel sensors 80, torque sensors 82, speed sensors 84, and emissions sensors 86. It is also contemplated that engine 10 may include other types of sensors, for example, temperature sensors, flow-rate sensors, pressure sensors, oxygen sensors, timing detectors, timers, and/or any other types of sensors known in the art.

Figure 2:
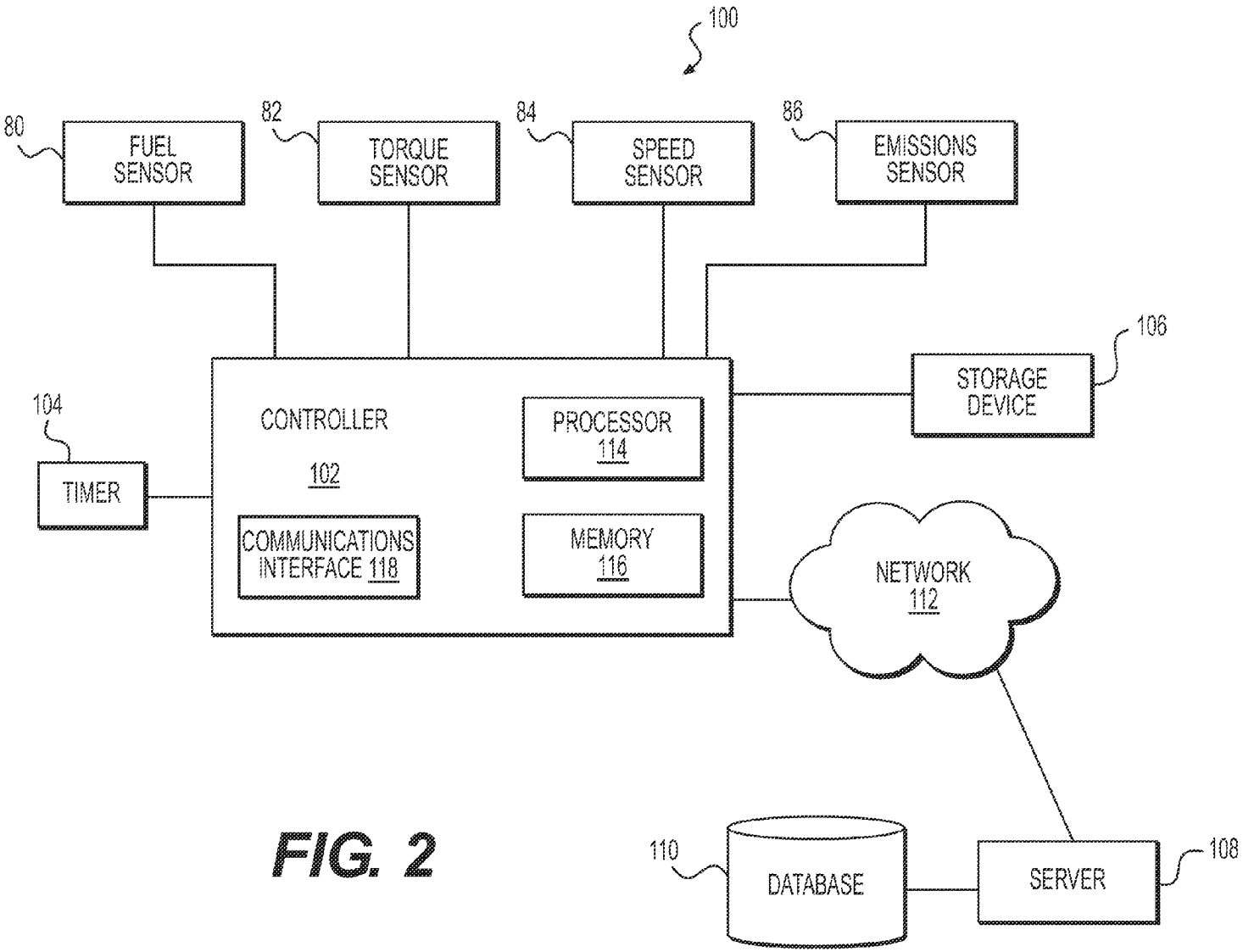
FIG. 2 is a diagrammatic view of an exemplary engine system for optimizing the performance of the engine of FIG. 1.

FIG. 2 illustrates a diagrammatic view of an engine system 100. Engine system 100 may include fuel sensor 80, torque sensor 82, speed sensor 84, emissions sensor 86, controller 102, timer 104, storage device 106, server 108, database 110, and network 112. Controller 102 may include processor 114, memory 116, and communications interface 118. Processor 114 may embody a single or multiple microprocessors, digital signal processors (DSPs), etc. Numerous commercially available microprocessors can be configured to perform the functions of processor 114. It should be appreciated that controller 102 could readily embody a processor 114 separate from that controlling other machine-related functions, or that processor 114 of controller 102 could be integral with a machine processor and be capable of controlling numerous machine functions and modes of operation. If separate from the general machine microprocessor, controller 102 may communicate with the general machine processor via data links or other methods. Various other known circuits may be associated with controller 102, including power supply circuitry, signal-conditioning circuitry, actuator driver circuitry (i.e., circuitry powering solenoids, motors, or piezo actuators), and communication circuitry.

Memory 116 may be configured to store data or one or more instructions and/or software programs that perform functions or operations when executed by processor 114. Memory 116 may embody, for example, Random Access Memory (RAM) devices, NOR or NAND flash memory devices, Read Only Memory (ROM) devices, etc. Although FIG. 2 illustrates controller 102 as having one processor 114 and one memory 116, it is contemplated that controller 102 may embody any number of processors 114 and memories 116.

Communications interface 118 may allow software and/or data to be transferred between controller 102 storage device 106, and/or server 108. Examples of communications interface 118 may include a network interface (e.g., a wireless network card), a communications port, a PCMCIA slot and card, a cellular network card, a global positioning system (GPS) transceiver, etc. Communications interface 118 may transfer software and/or data in the form of signals, which may be electronic, electromagnetic, optical, or other signals capable of being transmitted and received by communications interface 118. Communications interface 118 may transmit or receive these signals using a radio frequency ("RF") link, Bluetooth link, satellite links, and/or other wireless communications channels.

Controller 102 may also exchange data or information with storage device 106. Storage device 106 may be configured to store data or one or more instructions and/or software programs that perform functions or operations when executed by processor 114. Storage device 106 may embody, for example, hard drives, solid state drives, tape drives, RAID arrays, compact discs (CDs), digital video discs (DVDs), Blu-ray discs (BD), memory cards, etc. Although FIG. 2 illustrates only one storage device 106, engine system 100 may include any number of storage devices 106. Further, although FIG. 2 shows memory 116 and storage device 106 as part of engine system 100, memory 116 and/or storage device 106 may be located remotely and engine system 100 may be able to access memory 116 and/or storage device 106 via network 112.

Server 108 may be a general purpose computer, a mainframe computer, or any combination of these components. In certain embodiments, server 108 (or engine system 100 including server 108) may be standalone, or it may be part of a subsystem, which may be part of a larger system. For example, server 108 may represent distributed servers that are remotely located and communicate over a network (e.g., network 112) or a dedicated network, such as a local area network (LAN) or a wide area network (WAN). In addition, consistent with the disclosed embodiments, server 108 may be implemented as a server, a server system comprising a plurality of servers, or a server farm comprising a load balancing system and a plurality of servers. Like controller 102, server 108 may include one or more processors, one or more memories, and/or one or more storage devices.

Server 108 may be connected to database 110. Database 110 may include one or more logically and/or physically separate databases configured to store data. The data stored in the database 110 may be received from servers 108, from controller 102, and/or may be provided or provided as input using conventional methods (e.g., data entry, data transfer, data uploading, etc.) In one exemplary embodiment, database 110 may be implemented using a non-transitory computer-readable storage medium. In another exemplary embodiment, database 110 may be maintained in a network attached storage device, in a storage area network, or combinations thereof, etc. In yet another exemplary embodiment, database 110 may store the data on storage devices, which may include, for example, hard drives, RAID arrays, solid state drives, NOR or NAND flash memory devices, and/or Read Only Memory (ROM) devices. Furthermore, database 110 may be maintained and queried using numerous types of database software and programming languages, for example, SQL, MySQL, IBM DB2®, Microsoft Access®, PERL, C/C++, Java®, etc. In one exemplary embodiment, controller 102 and storage device 106 may be located on-board a machine associated with engine 10 and server 108 may be located off-board from the machine at a remote location. It is contemplated, however, that controller 102 may perform the functions of server 108 or that server 108 and database 110 may be located on board the machine associated with engine 10.

Network 112 may facilitate electronic communication and exchange of data between fuel sensor 80, torque sensor 82, speed sensor 84, emissions sensor 86, controller 102, storage device 106, and/or server 108. In certain exemplary embodiments, network 112 may include any combination of communications networks. For example, network 112 may include the Internet and/or another type of LAN or WAN, an intranet, a metropolitan area network, a wireless network, a cellular communications network, a satellite network, etc.

Controller 102 may be configured to receive signals generated by one or more sensors, for example, fuel sensor 80, torque sensor 82, speed sensor 84, emissions sensor 86, timer 104, and/or other sensors in engine 10. Controller 102 may be configured to use these signals to generate operating histograms for engine 10. As used in this disclosure, an operating histogram refers to a correlation between a speed "Si" of engine 10, an amount of fuel consumption "Fi" by engine 10 at speed Si, and an amount of time "ti" for which engine 10 operates at speed Si. For example, an operating histogram may include a first data point representing an amount of time "t1" for which engine 10 runs at speed "S1" while consuming an amount of fuel "F1." As another example, the operating histogram may include a second data point representing an amount of time "t2" for which engine 10 runs at speed "S2" while consuming an amount of fuel "F2." It is contemplated that the operating histogram may include any number of such operating points. One skilled in the art would recognize that fuel consumption amounts F1, F2, etc. may be indicative of the amounts of power generated by engine 10 at the different data points. It is also contemplated that controller 102 may determine an amount of power Pi generated by engine 10 based on the torque signal from torque sensor 82 and the speed signal from speed sensor 84.

Controller 102 may also be configured to select or generate a calibration parameter set for engine 10 based on the operating histogram. As used in this disclosure, the calibration parameter set may include control parameters used to control the operation of engine 10. For example, the control parameters may include one or more of a number of fuel injectors 34, an amount of fuel injection from the fuel injectors 34, a period of time between fuel injections, a pressure of the fuel injections, an amount of exhaust gas recirculation in engine 10, an amount of reductant injected in after-treatment system 38, an amount of boost received from turbocharger 36, a crank angle at which fuel injection commences, etc. It is contemplated that the calibration parameter set may be selected based on the operating histogram and other parameters such as ambient temperature, intake manifold temperature, coolant temperature and pressure, or any other operational parameters associated with engine 10. The calibration parameter set may also be associated with a fuel consumption rate corresponding to the control parameters included in the calibration parameter set. The fuel consumption rate may be measured in milli-liters per minute, gallons per minute, gallons per hour, etc. One of ordinary skill in the art would recognize that the list of control parameters described above is exemplary and that many other control parameters for engine control known in the art may be included in the calibration parameter set. Controller 102 may apply the calibration parameter set to engine 10 by controlling a variety of actuators and/or other controllers in engine 10 to set values or levels of the control parameters according to the calibration parameter set to control operation of engine 10.

In one exemplary embodiment, memory 116 of controller 102 may store a plurality of calibration parameter sets. Controller 102 may select a calibration parameter set from the plurality of calibration parameter sets, stored in memory 116, for use with engine 10. In another exemplary embodiment, the plurality of calibration parameter sets may be stored in storage device 106. Controller 102 may access the calibration parameter sets from storage device 106 before selecting a calibration parameter set for use with engine 10. In yet another exemplary embodiment, controller may run a variety of optimization algorithms using processor 114 to generate a calibration parameter set for use with engine 10. The engine optimization algorithms may include an operating model of engine 10 that relates the control parameters of engine 10 to engine performance parameters, for example, a speed Si of engine 10, an amount of output power Pi generated by engine 10, an amount of fuel consumption "Fi", and/or an amount of emissions "Ei" from engine 10. The operating model may embody tables, maps, and/or equations that relate the control parameters to engine performance parameters such as speed Si, amount of output power Pi, an amount of fuel consumption Fi, and/or an amount of emissions Ei. It is also contemplated that the engine operating model may embody software instructions, numerical models, neural networks, or any other type of engine operating model known in the art.

In another exemplary embodiment, controller 102 may be configured to upload an operating histogram to server 108 via network 112. Server 108 may then select or generate a calibration parameter set based on the uploaded operating histogram. Server 108 may perform processes similar to those of controller 102, discussed above, to select and/or generate the calibration parameter set. For example, server 108 may access database 110 to retrieve a plurality of calibration parameter sets stored in database 110. Server 108 may then select a calibration parameter set from among the calibration parameter sets retrieved from database 110. In another exemplary embodiment, server 108 may retrieve the engine operating model from database 110. Server 108 may execute one or more optimization algorithms, which may also be stored in database 110, to generate a calibration parameter set using the engine operating model. Controller 102 may be configured to download the calibration parameter set selected or generated by server 108 via network 112. Controller 102 may also be configured to apply the downloaded calibration parameter set to engine 10.

Figure 3:
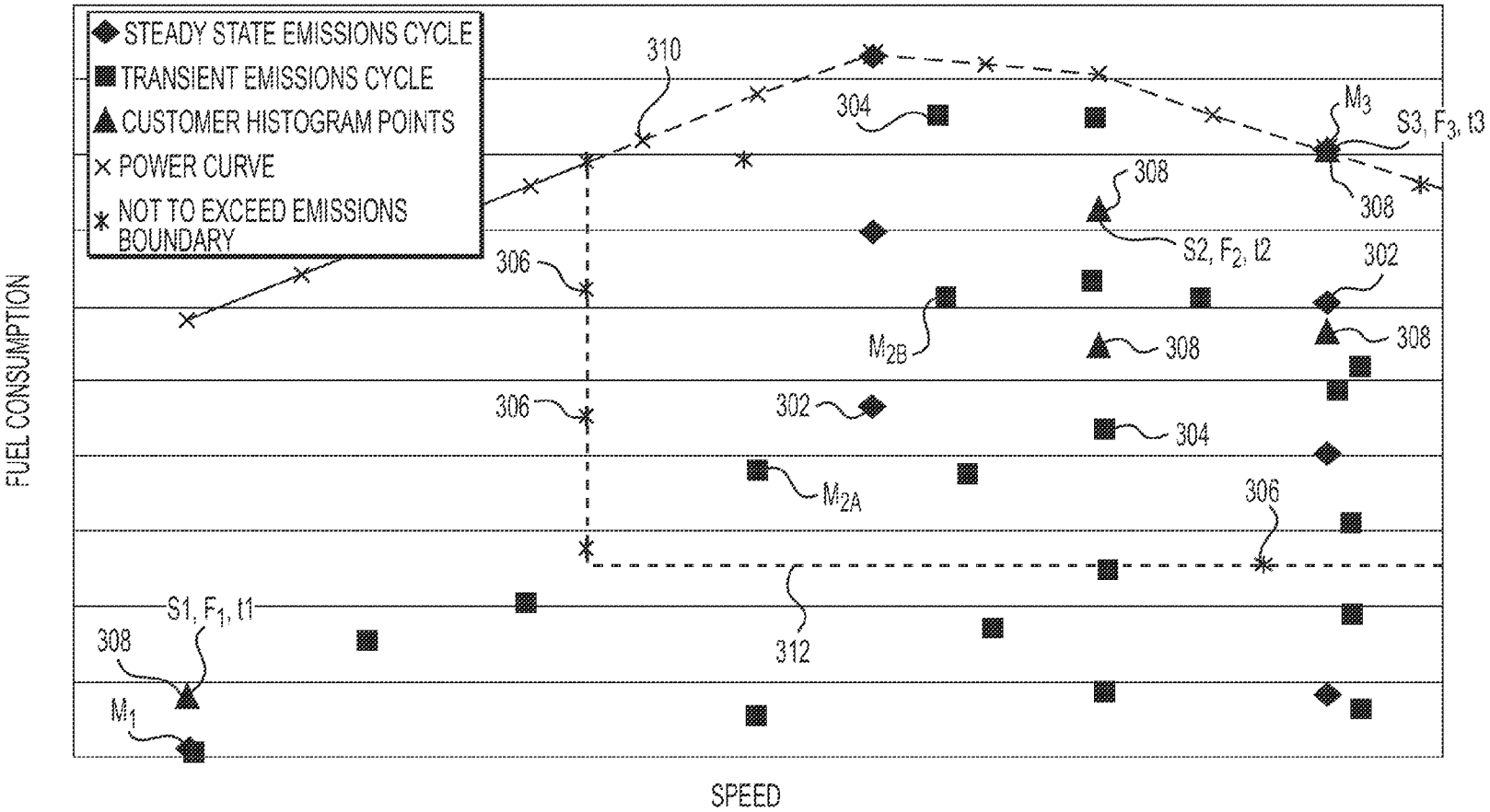
FIG. 3 is a chart illustrating exemplary modal points used for optimizing the performance of the engine of FIG. 1.

In yet another exemplary embodiment, controller 102 may generate calibration parameter sets for operating points in the operating histogram based on modal points. As used in this disclosure, modal points refer to operating points for which emissions limits have been established by emissions control regulations. FIG. 3 illustrates exemplary modal points that may be used by controller 102. As illustrated in FIG. 3, the modal points may include, for example, steady state emissions cycle modal points 302, transient emissions cycle modal points 304, and not to exceed emissions boundary points 306. FIG. 3 also illustrates operating points 308 corresponding to the operating histogram. In addition, FIG. 3 illustrates points 310 on a power curve, which represents the maximum amount of power Pi that engine 10 may generate at a given speed Si. One skilled in the art would recognize that the modal points are not limited to those illustrated in FIG. 3 and that many other distributions of modal points may be used by controller 102 and/or server 108.

The steady state emissions cycle modal points 302 may be associated with a first limit on an amount of emissions that may be generated by engine 10. For example, the emissions control regulations may require that a weighted average of the amounts of emissions discharged by engine 10 when operating at the steady state emissions cycle modal points must be lower than the first limit. In one exemplary embodiment, the emissions control regulations may specify weights for the modal points constituting the steady state emissions cycle. The transient emissions cycle modal points 304 may be associated with a second limit on the amount of emissions that may be generated by engine 10. For example, the emissions control regulations may require that a weighted total amount of emissions discharged by engine 10 when operating at the transient emissions cycle modal points must be lower than the second limit. In one exemplary embodiment, controller 102 or server 108 may determine weights for the modal points constituting the transient state emissions cycle. The not to exceed emissions boundary points may be associated with a third limit on the amount of emissions that may be generated by engine 10. For example, the total amount of emissions discharged by engine 10 when operating at one or more operating points within the boundary 312 defined by the not to exceed emissions boundary points 306 must be lower than a third limit. In one exemplary embodiment, the modal points may also include a power curve embodying operating points corresponding to maximum amounts of power that engine 10 may generate at various speeds. Controller 102 and/or server 108 may be configured to generate a calibration parameter set for operating points in the operating histogram by executing one or more optimization algorithms using an operating model of engine 10 as described above such that the engine complies with the first, second, or third limits corresponding to the modal points while minimizing fuel consumption for engine 10 when operated according to the operating histogram.

FIGS. 4-7 illustrate exemplary operations performed by engine system 100 to improve the operation of engine 10. FIGS. 4-7 will be discussed in more detail in the following section to further illustrate the disclosed concepts.

INDUSTRIAL APPLICABILITY

The disclosed engine system 100 may be implemented into any engine application, which must comply with stringent emissions control regulations and where it may be desirable to optimize the performance of engine 10. The disclosed engine system 100 may select a calibration parameter set, which may comply with the emissions control regulations while optimizing the performance of engine 10, when operating according to an operating histogram for a particular engine application. The disclosed engine system 100 may also provide an improved method of cloud based optimization by utilizing an off-board server 108 to generate a calibration parameter set corresponding to an engine operating histogram. In addition, the disclosed engine system 100 may provide an improved method of engine optimization based on relative weighting of modal points.

Figure 4:
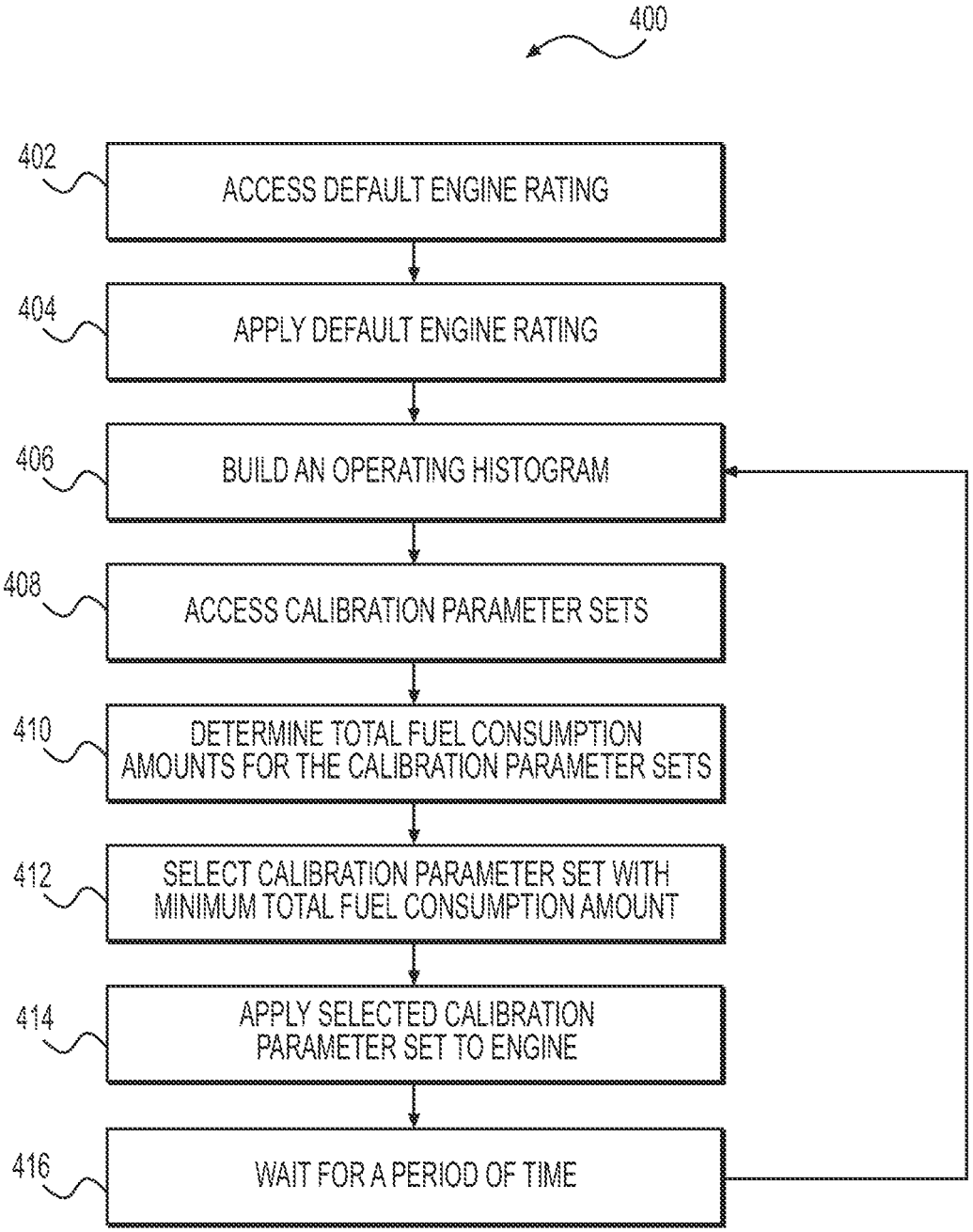
FIG. 4 is a flow chart illustrating an exemplary disclosed method of selective engine optimization performed by the engine system of FIG. 2.

FIG. 4 discloses an exemplary disclosed method 400 of selective engine optimization performed by engine system 100. As illustrated in FIG. 4, controller 102 may access a default calibration parameter set (Step 402). Accessing the default calibration parameter set may involve controller 102 reading values or settings for the control parameters, corresponding to the default calibration parameter set, from memory 116 or from storage device 106. In one exemplary embodiment, controller 102 may access storage device 106 via network 112. In another exemplary embodiment, accessing the default calibration parameter set may involve controller 102 sending a request for the default calibration parameter set via network 112 to server 108. Server 108 may access database 110 to retrieve the default calibration parameter set. Server 108 may send the default calibration parameter set to controller 102 via network 112. Additionally or alternatively, controller 102 may download the default calibration parameter set from server 108 or from database 110 via network 112.

Figure 5:
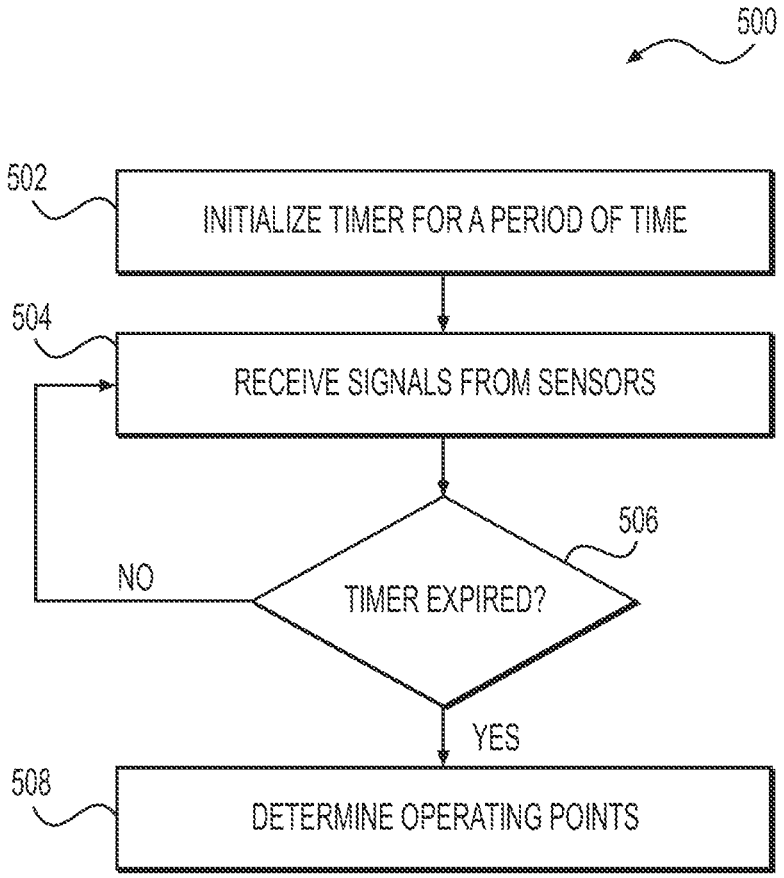
FIG. 5 is a flow chart illustrating an exemplary disclosed method of building an operating histogram performed by the engine system of FIG. 2.

Controller 102 may apply the default calibration parameter set to engine 10 (Step 404). To apply the default calibration parameter set, controller 102 may interact with a variety of actuators, controllers, etc. to specify values or levels for the control parameters as specified in the default calibration parameter set. Engine 10 may operate according to control parameters set by controller 102 in step 404. During operation of engine 10, controller 102 may build an operating histogram for engine 10 (Step 406). FIG. 5 illustrates an exemplary disclosed method 500 performed by engine system 100 to build an operating histogram for engine 10.

Controller 102 may initialize timer 104 for a period of time (Step 502). In one exemplary embodiment, controller 102 may initialize timer 104 for a first period of time. Timer 104 may count down from the first period of time until timer 104 expires. In other words, timer 104 may count down from the first period of time until the first period of time has elapsed. Controller 102 may receive sensor signals from sensors (Step 504) associated with engine 10, including signals from fuel sensor 80, torque sensor 82, speed sensor 84, emissions sensor 86, etc. Controller 102 may receive the sensor signals continuously or at predetermined time intervals, which may be uniform or non-uniform. Controller 102 may process the signals to extract data, for example, a speed Si, an amount of output power Pi, and a fuel consumption amount Fi of engine 10. In one exemplary embodiment, controller 102 may rely on the fuel consumption amount Fi as being indicative of power Pi. In another exemplary embodiment, controller 102 may determine the amount of power Pi based on signals from torque sensor 82 and speed sensor 84. Controller 102 may store the extracted data (e.g. Si, Pi, Fi) in memory 116 and/or storage device 106. Controller 102 may determine whether timer 104 has expired (Step 506).

When controller 102 determines that timer 104 has not expired (Step 506: NO), controller 102 may return to step 504 to continue to receive sensor signals from the sensors (fuel sensor 80, torque sensor 82, speed sensor 84, emissions sensor 86, etc.) associated with engine 10. When controller 102 determines, however, that timer 104 has expired (e.g. the first period of time has elapsed) (Step 506: YES), controller 102 may proceed to step 508 of determining operating points for an operating histogram. In step 508, controller 102 may access the data regarding, for example, speed "Sj," output power "Pj," and fuel consumption "Fj" of engine 10 stored in memory 116 and/or storage device 106 during the first period of time. Controller 102 may process the extracted data to identify operating points for engine 10. Controller 102 may divide the data collected in steps 502 through 506 into discrete sets. Controller 102 may determine a number of discrete sets based on, for example, a degree of and/or amounts of variation in Sj, Pj, Fj etc., over time. When the variation in Sj, Pj, Fj etc., over a period of time is smaller than a threshold amount, controller 102 may collect the data points Sj, Pj, Fj etc., for that period of time into a discrete set. When the variation in Sj, Pj, Fj etc., over that period of time is larger than the threshold amount, controller 102 may add a new discrete set and assign the data points Sj, Pj, Fj to more than one discrete set. Controller 102 may repeat the process until each discrete set has data points Sj, Pj, Fj etc., which do not vary by more than the threshold amount. It is contemplated that controller 102 may use other algorithms, equations, numerical models, and/or software instructions to divide the data points Sj, Pj, Fj, etc., into discrete sets. Each discrete set may represent an operating point on the operating histogram and may include a speed Si of engine 10, an amount of output power Pi of engine 10 at that speed Si, a fuel consumption amount Fi at speed Si, and an amount of time ti for which engine 10 operated at speed Si while delivering output power Pi or while consuming the fuel consumption amount Fi. The speed Si, output power Pi, and fuel consumption amount Fi for an operating point may be based on the values of Sj, Pj, and Fj of the points in a discrete set corresponding to that operating point. For example, Si, Pi, and Fi may be averages of values Sj, Pj, and Fj, respectively, of the points in a discrete set. It is contemplated, however, that Si, Pi, and Fi may be determined using other mathematical functions, operations, or algorithms applied to the values Sj, Pj, and Fj, respectively, of the points in the discrete set. Controller 102 may store the operating points embodying the operating histogram for engine 10 in memory 116 and/or storage device 106. In one exemplary embodiment, controller 102 may transfer the operating points via network 112 to server 108, which may store the operating histogram in database 110.

Returning to FIG. 4, controller 102 may access one or more calibration parameter sets from memory 116 or storage device 106 (Step 408). The calibration parameter sets stored in memory 116 or storage device 106 may be predetermined calibration parameter sets provided by, for example, the engine manufacturer based on engine operating conditions anticipated by the manufacturer. Each stored calibration parameter set may specify the values or levels of control parameters for engine 10 such that engine 10 complies with emissions control requirements when operating under those control parameter settings. Each stored calibration parameter set may also include fuel consumption rates for a plurality of engine operating points. The fuel consumption rates may be provided as tables of values, mathematical equations, maps, or in any other form known in the art.

Controller 102 may determine total fuel consumption amounts for the calibration parameter sets (Step 410) obtained in step 408. Controller may determine the total fuel consumption amounts based on fuel consumption rates for the plurality of operating points specified in each calibration parameter set and based on the operating histogram for engine 10. For example, assume that calibration parameter set R1 specifies a fuel consumption rate "FR1" for an engine operating point consisting of an engine speed S1 and an amount of output power P1 and a fuel consumption rate "FR2" for an engine speed S2 and an amount of output power P2. Further assume, for example, that the engine operating histogram shows that engine 10 operates at speed S1 for time t1 while delivering output power P1 and that engine 10 operates at speed S2 for time t2 while delivering output power P2. Controller 102 may determine a total fuel consumption amount for calibration parameter set R1 in this example as FR1×t1+FR2×t2. It is contemplated, however, that controller 102 may determine total fuel consumption amounts for the calibration parameter sets using lookup tables, maps, equations, numerical models, or by executing instructions representing other types of algorithms known in the art.

Controller 102 may select a calibration parameter set with a minimum total fuel consumption amount (Step 412) from among the total fuel consumption amounts determined in step 410. For example, if two calibration parameter sets R1 and R2 are available for engine 10, the total fuel consumption amounts for calibration parameter sets R1 and R2 are "FC1" and "FC2," respectively, and FC2 is less than FC1, controller 102 may select calibration parameter set R2 for engine 10. Controller 102 may apply the selected calibration parameter set (e.g. R2) to engine 10 (Step 414). Applying the selected calibration parameter set to engine 10 may include performing operations similar to those discussed above with respect to step 404 for applying the default calibration parameter set to engine 10.

After applying the selected calibration parameter set to engine 10, controller 102 may wait for a period of time (Step 416). In one exemplary embodiment, controller 102 may wait for a second period of time, which may be the same as or different from the first period of time. After the second period of time has elapsed, controller 102 may return to step 406 of building an operating histogram. In another exemplary embodiment, controller 102 may proceed from step 414 to step 406 without waiting for a period of time. Thus, for example, controller 102 may set the second period of time to zero. In building the operating histogram after proceeding from step 414 to 406, controller may initialize timer 104 for a third period of time (Step 502 of FIG. 5), which may be the same as or different from the first period of time.

Controller 102 may execute one or more of steps 502 to 508 of method 500 to regenerate and/or update an operating histogram for engine 10 based on data collected during the first period of time and the third period of time. In one exemplary embodiment, controller 102 may regenerate the operating histogram based on data collected during the first period of time and the third period of time. In another exemplary embodiment, controller 102 may populate the discrete sets in an operating histogram, previously generated in step 406 after the first period of time, with data collected during the third period of time. In yet another exemplary embodiment, controller 102 may use algorithms for estimating moving averages of data points Sj, Pj, tj collected during the first and third periods of time to update the previously generate operating histogram based on data collected during the first period of time. It is also contemplated, that in some embodiments, controller 102 may zero out a previously generated operating histogram and generate a new operating histogram based only on the data collected during, for example, the third period of time.

Controller 102 may execute steps 406 to 416 one or more times during operation of engine 10 to continuously update the operating histogram and to continuously select a calibration parameter set to reduce total fuel consumption for the operating histogram. In this manner, engine system 100 may help ensure that engine 10 may be operated with a reduced total fuel consumption amount while still meeting emissions control regulations and delivering the power required by the operating histogram. Further, by continuously updating the operating histogram and selecting a calibration parameter set that reduces total fuel consumption for the updated operating histogram, engine system 100 may help ensure that engine 10 may be operated efficiently even when the operating conditions of engine 10 change during use.

Figure 6:
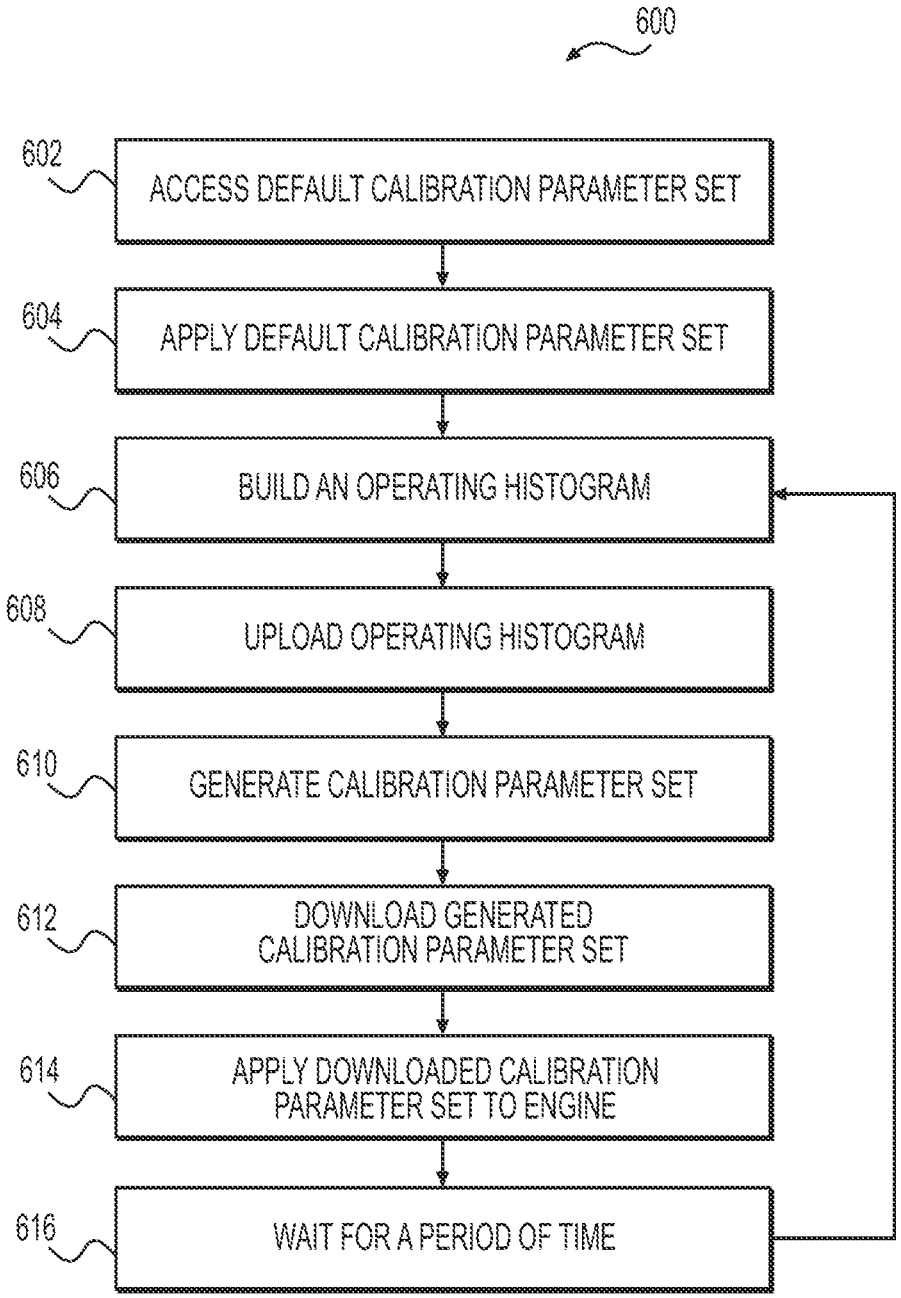
FIG. 6 is a flow chart illustrating an exemplary disclosed method of cloud based engine optimization performed by the engine system of FIG. 2.

FIG. 6 discloses an exemplary disclosed method 600 of cloud based engine optimization performed by engine system 100. As illustrated in FIG. 6, controller 102 may access a default calibration parameter set (Step 602). Accessing the default calibration parameter set may include controller 102 performing operations similar to those discussed above with respect to step 402 of method 400. Controller 102 may apply the default calibration parameter set to engine 10 (Step 604). Applying the default calibration parameter set to engine 10 may include controller 102 performing operations similar to those discussed above with respect to step 404 of method 400. Engine 10 may operate according to the control parameters set by controller 102 in step 604. Controller 102 may build an operating histogram for engine 10 (Step 606). As part of step 606, controller 102 may execute one or more steps 502 to 508 of method 500 discussed above. Controller may upload the operating histogram for engine 10 to server 108 (Step 608). Uploading the operating histogram may include controller 102 transferring the operating points determined in step 508 of method 500 to server 108 via network 112. Server 108 may store the operating points provided by controller 102 in database 110.

Server 108 may generate a calibration parameter set (Step 610) for the operating histogram received in step 608. Generating a calibration parameter set may include server 108 executing a variety of optimization algorithms using an operating model of engine 10 that relates control parameters of engine 10 to performance parameters, for example, a speed Si, output power Pi, a fuel consumption amount "Fi," and/or an amount of emissions "Ei." The operating model may embody tables, maps, and/or equations that relate the control parameters to engine performance parameters such as speed Si, output power Pi, a fuel consumption amount Fi, and/or amount of emissions Ei. It is also contemplated that the engine operating model may embody software instructions, numerical models, neural networks, or any other type of engine operating model known in the art.

Server 108 may generate values or levels of the control parameters such that a predicted amount of emissions generated by engine 10 remains lower than emissions limits established by the emissions control regulations, while allowing engine 10 to operate with a reduced fuel consumption amount, and while delivering the desired output power Pi at engine speed Si corresponding to the operating points in the operating histogram. Thus for example, an operating histogram for engine 10 may include operating points embodying the speed, the fuel consumption amount, and the time represented by (S1, F1, t1), (S2, F2, t2), (S3, F3, t3), etc. (see FIG. 3). Assume, for example, that engine 10 spends a longer amount of time t3 at an operating point characterized by (S3, F3, t3) compared to an amount of time t1 at an operating point characterized by (S1, F1, t1). Server 108 may generate control parameters which minimize a fuel consumption amount at the operating point characterized by (S3, F3, t3). Minimizing the fuel consumption amount at the operating point characterized by (S3, F3, t3) may however increase an amount of emissions generated by engine 10 at the operating point characterized by (S3, F3, t3). To ensure that engine 10 complies with emissions control regulations, server 108 may generate control parameters that help to minimize an amount of emissions generated by engine 10 at the operating point characterized by (S1, F1, t1) to offset the increased amount of emissions generated by engine 10 at the operating point characterized by (S3, F3, t3). In one exemplary embodiment, server 108 may compare the predicted amount of emissions Ei with a measured amount of emissions from emissions sensor 86. Server 108 may also adjust the values or levels of control parameters to ensure that the measured amount of emissions remains lower than emissions limits established by the emissions control regulations. Server 108 may store the calibration parameter set embodying the determined values of the control parameters in database 110.

Controller 102 may download the calibration parameter set generated by server 108 (Step 612). In one exemplary embodiment, downloading the calibration parameter set may include transmitting the calibration parameter set by the server 108 to controller 102 via network 112. In another exemplary embodiment, server 108 may send instructions to controller 102 to access database 110 to retrieve the calibration parameter set. Controller 102 may execute the instructions provided by server 108 to download the calibration parameter set from database 110. Controller 102 may store the downloaded calibration parameter set in memory 116 or in storage device 106.

Controller 102 may apply the downloaded calibration parameter set to engine 10 (Step 614). Applying the downloaded calibration parameter set to engine 10 may include controller 102 performing operations similar to those discussed above with respect to step 414 of method 400. After applying the selected calibration parameter set to engine 10, controller 102 may wait for a period of time (Step 616). In one exemplary embodiment, controller 102 may wait for a second period of time, which may be the same as or different from the first period of time. After the second period of time has elapsed, controller 102 may return to step 606 of building an operating histogram to generate an updated operating histogram for engine 10. In another exemplary embodiment, controller 102 may proceed from step 614 to step 606 without waiting for a period of time. Thus, for example, controller 102 may set the second period of time to zero. In building the operating histogram after the first period of time, controller may initialize timer 104 for a third period of time (Step 502 of FIG. 5), which may be the same as or different from the first period of time.

Controller 102 may execute one or more of steps 502 to 508 of method 500 to regenerate and/or update an operating histogram for engine 10 based on data collected during the first period of time and the third period of time. In one exemplary embodiment, controller 102 may regenerate the operating histogram based on data collected during the first period of time and the third period of time. In another exemplary embodiment, controller 102 may populate the discrete sets in an operating histogram, previously generated in step 606 after the first period of time, with data collected during the third period of time. In yet another exemplary embodiment, controller 102 may use algorithms for estimating moving averages of data points Sj, Pj, tj collected during the first and third periods of time to update the previously generate operating histogram based on data collected during the first period of time. It is also contemplated, that in some embodiments, controller 102 may zero out a previously generated operating histogram and generate a new operating histogram based only on the data collected during, for example, the third period of time.

Controller 102 may execute steps 606 to 616 one or more times during the operation of engine 10 to continuously update the operating histogram and to continuously generate a calibration parameter set for the updated operating histogram. In some exemplary embodiments, controller 102 may execute steps 606 to 616 one or more times during the operation of engine 10 periodically to update the operating histogram and to periodically receive a calibration parameter set for the updated operating histogram from server 108 and/or database 110. In this manner, engine system 100 may help ensure that engine 10 may be operated with a reduced total fuel consumption amount while still complying with emissions control regulations. Further, using an off-board server 108 to generate a calibration parameter set tailored to an operating histogram of engine 10 may help ensure that engine 10 may be operated efficiently, while meeting the emissions control regulations, even when the processing capabilities of an on-board controller 102 may be limited.

Figure 7:
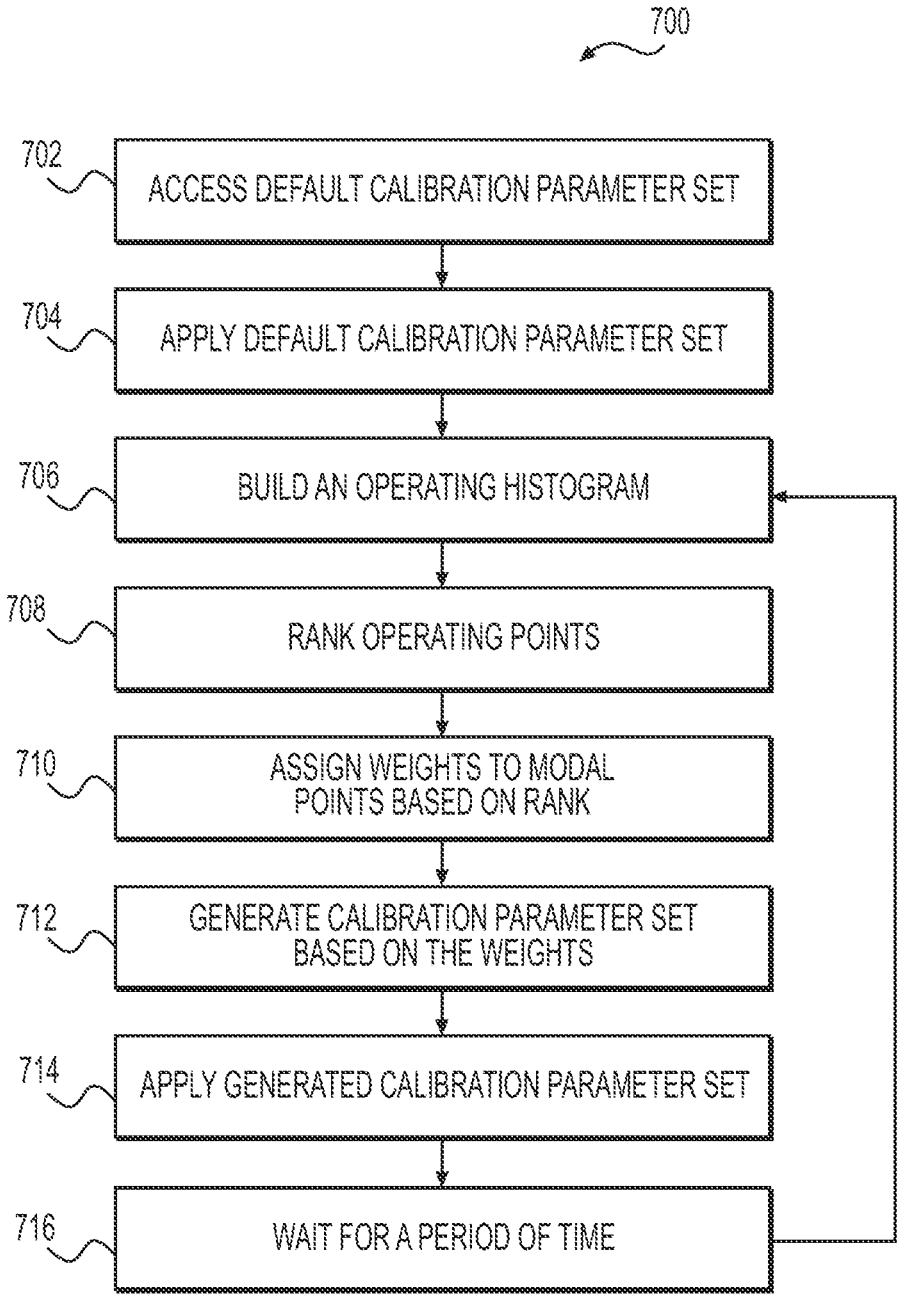
FIG. 7 is a flow chart illustrating an exemplary disclosed method of modal weighted engine optimization performed by the engine system of FIG. 2.

FIG. 7 discloses an exemplary disclosed method 700 of modal weighted engine optimization performed by engine system 100. As illustrated in FIG. 7, controller 102 may access a default calibration parameter set (Step 702). Accessing the default calibration parameter set may include controller 102 performing operations similar to those discussed above with respect to step 402 of method 400. Controller 102 may apply the default calibration parameter set to engine 10 (Step 704). Applying the default calibration parameter set to engine 10 may include controller 102 performing operations similar to those discussed above with respect to step 404 of method 400. Engine 10 may operate according to the control parameters set by controller 102 in step 704. During operation of engine 10, controller 102 may build an operating histogram for engine 10 (Step 706). As part of step 706, controller 102 may execute one or more steps 502 to 508 of method 500 discussed above to build the operating histogram. As discussed above, the operating histogram may include operating points that correlate a speed "Si" of engine 10, an amount of fuel consumption "Fi," and an amount of time "ti" for which engine 10 operates at speed Si. Thus for example, an operating histogram for engine 10 may include operating points embodying the speed, the fuel consumption amount, and the time represented by (S1, F1, t1), (S2, F2, t2), (S3, F3, t3), etc. (see FIG. 3). Controller 102 may store the operating histogram in memory 116 and/or storage device 106. In one exemplary embodiment, controller 102 may upload the operating histogram for engine 10 to server 108. Uploading the operating histogram may include controller 102 transferring the operating points determined in step 508 of method 500 to server 108 via network 112. Server 108 may store the operating points provided by controller 102 in database 110.

Controller 102 may rank the operating points based on amounts of time corresponding to the operating points (Step: 708). In one exemplary embodiment, controller 102 may rank the operating points based on a descending order of the amounts of time. Thus, for example, if t3>t2>t1, controller 102 may rank operating point characterized by (S3, F3, t3) higher than the operating point characterized by (S2, F2, t2), which may be ranked higher than the operating point characterized by (S1, F1, t1). Controller 102 may assign weights to at least some of the modal points based on the rank (Step: 710) determined in Step 708. For example, controller 102 may assign weights to modal points belonging to transient emissions cycle modal points 304, and not to exceed emissions boundary points 306, but not to steady state emissions cycle modal points 302 for which weights may be determined by the emissions control regulations.

Assigning weights to the modal points in step 710 may include identifying modal points adjacent to each of the operating points. For example, as illustrated in FIG. 3, modal point M1 may lie adjacent to an operating point characterized by (S1, F1, t1) and modal point M3 may lie adjacent to an operating point characterized by (S3, F3, t3). As further illustrated in FIG. 3, modal points M2A and M2B may lie adjacent to an operating point characterized by (S2, F2, t2). Controller 102 may identify the adjacent modal points, for example, M1, M2A, M2B, M3, etc. by determining a vector distance between the modal points and the operating points. In one exemplary embodiment, controller 102 may identify the adjacent modal points by selecting modal points that may have the smallest cosine distance from the operating points. It is contemplated, however, that controller 102 may identify the adjacent modal points based on a root-mean-square distance, or based on any other type of distance calculation known in the art. Controller 102 may assign weights to the modal points identified as being adjacent to the operating points. Thus, for example, controller may assign weights w1, w2A, w2B, and w3 to modal points M1, M2A, M2B, and M3, respectively, of FIG. 3. Further, assuming that t3>t2>t1, weight w3 of modal point M3 may be higher than the weights w2A and w2B, which in turn may be higher than weight w1 of modal point M1.

Controller 102 may generate a calibration parameter set (Step 712) for the operating points based on the weights assigned to the modal points in step 710. Generating a calibration parameter set may include controller 102 executing a variety of optimization algorithms using an operating model of engine 10 that relates control parameters of engine 10 to performance parameters of engine 10, for example, a speed Si, output power Pi, a fuel consumption amount "Fi," and/or an amount of emissions "Ei." The operating model may embody tables, maps, and/or equations that relate the control parameters to engine performance parameters such as speed Si, output power Pi, a fuel consumption amount Fi, and/or amount of emissions Ei. It is also contemplated that the engine operating model may embody software instructions, numerical models, neural networks, or any other type of engine operating model known in the art. Controller 102 may generate values or levels of the control parameters corresponding to the modal points so that amounts of emissions generated by engine 10 remain lower than the first, second, or third limits corresponding to the modal points. Further, the optimization algorithm may generate control parameters based on the weights assigned to the modal points adjacent the operating points. Thus, in the example discussed above, because weight w3 for modal point M3 is greater than weight w1 for modal point M1, controller 102 may select calibration parameters that reduce fuel consumption amount F3 at modal point M3 compared to fuel consumption amounts at other modal points. Controller 102 may also generate control parameters, which may reduce the amount of emissions E1 for modal point M1 compared to amounts of emissions generated by engine 10 when operating at other modal points, while permitting a higher fuel consumption amount F1 at modal point M1 relative to fuel consumption amounts at the other modal points. Controller 102 may assign control parameters corresponding to modal point M1 to an operating point characterized by (S1, P1, t1) and control parameters corresponding to modal point M3 to an operating point characterized by (S3, P3, t3). Because the operating point characterized by (S2, P2, t2) lies between modal points M2A and M2B, controller 102 may interpolate between control parameters determined for modal points M2A and M2B to determine the control parameters for the operating point characterized by (S2, P2, t2). Controller 102 may determine the control parameters so that an amount of emissions Ei generated by engine 10 at each operating point in the operating histogram and a total amount of emissions generated by engine 10 while operating according to the operating histogram comply with the first, second, and third limits established by the modal points while at the same time reducing a total fuel consumption amount for engine 10.

Controller 102 may apply the generated calibration parameter set to engine 10 (Step 714). Applying the generated calibration parameter set to engine 10 may include controller 102 executing operations similar to those discussed above with respect to step 414 of method 400. After applying the selected calibration parameter set to engine 10, controller 102 may wait for a period of time (Step 716). In one exemplary embodiment, controller 102 may wait for a second period of time, which may be the same as or different from the first period of time. In another exemplary embodiment, controller 102 may proceed from step 714 to step 706 without waiting for a period of time. Thus, for example, controller 102 may set the second period of time to zero. In building the operating histogram, controller may initialize timer 104 for a third period of time (Step 502 of FIG. 5), which may be the same as or different from the first period of time.

Controller 102 may execute one or more of steps 502 to 508 of method 500 and steps 706 to 718 of method 700 to regenerate and/or update an operating histogram for engine 10 based on data collected during the first period of time and the third period of time. In one exemplary embodiment, controller 102 may regenerate the operating histogram based on data collected during the first period of time and the third period of time. In another exemplary embodiment, controller 102 may populate the discrete sets from an operating histogram, previously generated at step 706 after the first period of time, with data collected during the third period of time. In yet another exemplary embodiment, controller 102 may use algorithms for estimating moving averages of data points Sj, Pj, tj collected during the first and third periods of time to update the previously generate operating histogram based on data collected during the first period of time. It is also contemplated, that in some embodiments, controller 102 may zero out a previously generated operating histogram and generate a new operating histogram based only on the data collected during, for example, the third period of time.

Controller 102 may execute steps 706 to 716 one or more times during the operation of engine 10 to continuously update the operating histogram and to continuously generate a calibration parameter set for the updated operating histogram. In some exemplary embodiments, controller 102 may execute steps 706 to 716 one or more times during the operation of engine 10 periodically to update the operating histogram and to periodically generate a calibration parameter set for the updated operating histogram. In this manner, engine system 100 may help ensure that engine 10 may be operated with a reduced fuel consumption amount while still meeting emissions control regulations. Additionally, selecting and applying calibration parameter sets based on modal points associated with an operating histogram of engine 10 may help ensure that engine 10 may be operated efficiently, while meeting the emissions control regulations, even when the operating conditions of engine 10 change from one engine application to another.

It will be apparent to those skilled in the art that various modifications and variations can be made to the disclosed engine system. Other embodiments will be apparent to those skilled in the art from consideration of the specification and practice of the disclosed engine system. It is intended that the specification and examples be considered as exemplary only, with a true scope being indicated by the following claims and their equivalents.

What is claimed is:

1. An engine system, comprising:
- an engine;
- a sensor configured to generate a sensor signal indicative of a power generated by the engine;
- a speed sensor configured to generate a speed signal indicative of a speed of the engine; and
- a controller configured to:
  - receive the sensor signal and the speed signal;
  - generate an operating histogram based on the sensor signal and the speed signal;
  - receive modal points for the engine, the modal points having associated emissions limits, each modal point including the speed of the engine and an amount of output power of the engine corresponding to the speed;
  - select a subset of modal points;
  - determine weights for the subset of modal points based on the operating histogram;
  - assign predetermined weights to the modal points not included in the subset;
  - generate a calibration parameter set for the operating histogram based on the determined weights and the predetermined weights; and
  - apply the calibration parameter set to the engine.

2. The engine system of claim 1, wherein the modal points include steady state emissions cycle modal points, transient emissions cycle modal points, and not to exceed emissions boundary points, and the emissions limits include:
- a first limit on a weighted average of amounts of emissions generated by the engine when operating at the steady state emissions cycle modal points;
- a second limit on a weighted total amount of emissions generated by the engine when operating at the transient emissions cycle modal points; and
- a third limit on a maximum amount of emissions generated by the engine when operating within a boundary determined by the not to exceed emissions boundary points.

3. The engine system of claim 1, wherein the controller is configured to generate the operating histogram by:
- initializing a timer for a first period of time;
- receiving the sensor signal and the speed signal during the first period of time; and
- identifying a plurality of engine operating points based on the sensor signal and the speed signal, each operating point including:
  - the speed of the engine;
  - an amount of power generated by the engine at the speed; and
  - an amount of time of engine operation at the speed.

4. The engine system of claim 3, wherein the controller is configured to assign the weights to the subset of modal points by:
- identifying at least a first operating point at which the engine spends a maximum amount of time;
- identifying at least a second operating point at which the engine spends a minimum amount of time;
- identifying a first modal point adjacent the first operating point from the subset;
- identifying a second modal point adjacent the second operating point from the subset;
- assigning a first weight to the first modal point based on a first amount of time associated with the first operating point; and
- assigning a second weight to the second modal point based on a second amount of time associated with the second operating point.

5. The engine system of claim 4, wherein the controller is configured to generate the calibration parameter set by determining control parameters for the engine that:
- reduce a first fuel consumption amount at one of the first modal point and the second modal point based on the first weight and the second weight; and
- reduce a first amount of emissions at an other of the first modal point and the second modal point.

6. The engine system of claim 5, wherein the first weight is greater than the second weight when the first amount of time is greater than the second amount of time.

7. The engine system of claim 5, wherein the controller is further configured to generate the calibration parameter set by:
- identifying at least a third operating point for the engine;

identifying a third modal point adjacent the third operating point;

identifying a fourth modal point adjacent the third operating point;

determining a first set of control parameters for the third modal point;

determining a second set of control parameters for the fourth modal point;

determining a third set of control parameters by interpolating between the first set of control parameters and the second set of control parameters; and associating the third set of control parameters with the third operating point.

8. The engine system of claim 3, wherein the controller is further configured to:

initialize the timer for a second period of time;

receive the sensor signal and the speed signal during the second period of time; and update the operating histogram after the second period of time.

9. The engine system of claim 1, wherein the sensor is a fuel sensor.

10. A method of optimizing an operation of an engine, comprising:

receiving, from a sensor, a sensor signal indicative of an amount of power generated by the engine;

receiving, from a speed sensor, a speed signal indicative of a speed of the engine;

generating, using a controller, an operating histogram based on the sensor signal and the speed signal, the operating histogram;

defining modal points for the engine, the modal points having associated emissions limits, each modal point including the speed of the engine and an amount of output power of the engine corresponding to the speed;

selecting a subset of modal points;

determining weights for the subset of modal points based on the operating histogram;

assigning predetermined weights to the modal points not included in the subset;

generating a calibration parameter set for the operating histogram based on the determined weights and the predetermined weights;

applying the calibration parameter set to the engine.

11. The method of claim 10, wherein the modal points include steady state emissions cycle modal points, transient emissions cycle modal points, and not to exceed emissions boundary points, and the emissions limits include:

a first limit on a weighted average of amounts of emissions generated by the engine when operating at the steady state emissions cycle modal points;

a second limit on a weighted total amount of emissions generated by the engine when operating at the transient emissions cycle modal points; and a third limit on a maximum amount of emissions generated by the engine when operating within a boundary determined by the not to exceed emissions boundary points.

12. The method of claim 11, wherein generating the operating histogram includes:

initializing a timer for a first period of time;

receiving the sensor signal and the speed signal during the first period of time;

identifying a plurality of engine operating points based on the sensor signal and the speed signal, each operating point corresponding to an amount of power generated by the engine and the speed of the engine; and determining an amount of time spent by the engine at the each operating point.

13. The method of claim 12, wherein assigning weights to the subset of modal points includes:

identifying at least a first operating point at which the engine spends a maximum amount of time;

identifying at least a second operating point at which the engine spends a minimum amount of time;

identifying a first modal point adjacent the first operating point from the subset;

identifying a second modal point adjacent the second operating point from the subset;

assigning a first weight to the first modal point based on a first amount of time associated with the first operating point; and assigning a second weight to the second modal point based on a second amount of time associated with the second operating point.

14. The method of claim 13, wherein generating the calibration parameter set includes determining control parameters that:

reduce a first fuel consumption amount at one of the first modal point and the second modal point based on the first weight and the second weight; and reduce a first amount of emissions at an other of the first modal point and the second modal point.

15. The method of claim 14, wherein the first weight is greater than the second weight when the first amount of time is greater than the second amount of time.

16. The method of claim 14, wherein generating the calibration parameter set further includes:

identifying a third operating point for the engine;

identifying a third modal point adjacent the third operating point;

identifying a fourth modal point adjacent the third operating point;

determining a first set of control parameters for the third modal point;

determining a second set of control parameters for the fourth modal point;

determining a third set of control parameters by interpolating between the first set of control parameters and the second set of control parameters; and associating the third set of control parameters with the third operating point.

17. The method of claim 12, further including:

initializing the timer for a second period of time;

receiving the sensor signal and the speed signal during the second period of time; and updating the operating histogram after the second period of time.

18. An engine, comprising:

a crankshaft;

a combustion chamber;

a fuel injector configured to inject fuel into the combustion chamber;

a piston disposed reciprocatingly within the combustion chamber, the piston being configured to rotate the crankshaft;

a sensor configured to generate a sensor signal indicative of power output by the engine;

a speed sensor configured to generate a speed signal indicative of a speed of the engine; and a controller configured to:

receive the sensor signal and the speed signal;

generate an operating histogram based on the sensor signal and the speed signal;

receive modal points for the engine, the modal points having associated emissions limits, each modal point including the speed of the engine and an amount of output power of the engine corresponding to the speed;

select a subset of modal points;

determine weights for the subset of modal points based on the operating histogram;

assign predetermined weights to the modal points not included in the subset;

generate a calibration parameter set for the operating histogram based on the determined weights and the predetermined weights; and apply the calibration parameter set to the engine.

19. The engine of claim 18, wherein the controller is configured to select engine ratings by:

identifying at least a first operating point at which the engine spends a maximum amount of time;

identifying at least a second operating point at which the engine spends a minimum amount of time;

identifying a first modal point adjacent the first operating point from the subset of modal points;

identifying a second modal point adjacent the second operating point from the subset of modal points;

assigning a first weight to the first modal point based on a first amount of time associated with the first operating point;

assigning a second weight to the second modal point based on a second amount of time associated with the second operating point;

determining control parameters that:

reduce a first fuel consumption amount at one of the first modal point and the second modal point based on the first weight and the second weight; and reduce a first amount of emissions at an other of the first modal point and the second modal point.

20. The engine of claim 19, wherein the controller is configured to reduce the fuel consumption amount at the first modal point when the first weight is greater than the second weight.

* * * * *